US010580416B2

(12) United States Patent
Vasilache et al.

(10) Patent No.: US 10,580,416 B2
(45) Date of Patent: Mar. 3, 2020

(54) BIT ERROR DETECTOR FOR AN AUDIO SIGNAL DECODER

(71) Applicant: Nokia Technologies Oy, Espoo (FI)

(72) Inventors: Adriana Vasilache, Tampere (FI); Anssi Sakari Rämö, Tampere (FI); Lasse Juhani Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 123 days.

(21) Appl. No.: 15/741,440

(22) PCT Filed: Jul. 6, 2015

(86) PCT No.: PCT/EP2015/065396

§ 371 (c)(1),
(2) Date: Jan. 2, 2018

(87) PCT Pub. No.: WO2017/005296

PCT Pub. Date: Jan. 12, 2017

(65) Prior Publication Data

US 2018/0374489 A1 Dec. 27, 2018

(51) Int. Cl.
*G10L 19/00* (2013.01)
*G10L 19/005* (2013.01)
(Continued)

(52) U.S. Cl.
CPC ..... *G10L 19/005* (2013.01); *G10L 19/012* (2013.01); *G10L 19/038* (2013.01);
(Continued)

(58) Field of Classification Search
CPC ..... G10L 19/038; G10L 19/005; G10L 19/24; G10L 19/0017; G10L 19/012; G10L 19/0208; G10L 19/0212; G10L 19/022; G10L 19/032; G10L 19/035; G10L 19/08; G10L 18/093; G10L 19/12; G10L 19/125; G10L 19/26
(Continued)

(56) References Cited

U.S. PATENT DOCUMENTS 4,958,225 A 9/1990 Bi et al.
5,699,485 A 12/1997 Shoham
(Continued)

FOREIGN PATENT DOCUMENTS

CN 1128462 A 8/1996
CN 1188957 A 7/1998
(Continued)

OTHER PUBLICATIONS

International Search Report and Written Opinion received for corresponding Patent Cooperation Treaty Application No. PCT/EP2015/065396, dated Nov. 5, 2015, 13 pages.
(Continued)

*Primary Examiner* — Vijay B Chawan
(74) *Attorney, Agent, or Firm* — Alston & Bird LLP

(57) ABSTRACT

A method comprising: receiving lattice vector quantised parameter data, the parameter data representing at least one audio signal; determining within the data at least one bit error; and controlling the decoding of the data to generate an audio signal based on the determining of the bit error.

16 Claims, 7 Drawing Sheets

(51) Int. Cl.

| | |
|---|---|
| ***G10L 19/012*** | (2013.01) |
| ***G10L 19/038*** | (2013.01) |
| ***G10L 19/24*** | (2013.01) |
| ***G10L 19/07*** | (2013.01) |

(52) U.S. Cl.
CPC ..... *G10L 19/07* (2013.01); *G10L 19/24* (2013.01); *G10L 2019/0005* (2013.01); *G10L 2019/0008* (2013.01); *G10L 2019/0016* (2013.01)

(58) Field of Classification Search
USPC ..... 704/200–504; 375/240.22, 240, 240.03
See application file for complete search history.

(56) References Cited

U.S. PATENT DOCUMENTS

| | | | | |
|---|---|---|---|---|
| 5,920,853 | A * | 7/1999 | Benyassine | G06T 9/008 |
| 6,658,383 | B2 | 12/2003 | Koishida et al. | |
| 7,587,314 | B2 * | 9/2009 | Vasilache | G10L 19/24 704/222 |
| 8,468,017 | B2 | 6/2013 | Shlomot et al. | |
| 8,831,933 | B2 * | 9/2014 | Duni | G10L 19/038 704/222 |
| 2005/0137863 | A1 | 6/2005 | Jasiuk et al. | |
| 2005/0143984 | A1 | 6/2005 | Makinen et al. | |
| 2005/0228658 | A1 | 10/2005 | Yang et al. | |
| 2006/0271354 | A1 | 11/2006 | Sun et al. | |
| 2007/0094035 | A1 * | 4/2007 | Vasilache | G10L 19/0208 704/500 |
| 2008/0316975 | A1 | 12/2008 | Ashikhmin | |
| 2010/0014577 | A1 | 1/2010 | Vasilache et al. | |
| 2010/0022223 | A1 * | 1/2010 | Taylor | G08G 1/0969 455/414.1 |
| 2010/0211398 | A1 | 8/2010 | Satoh et al. | |
| 2011/0026581 | A1 * | 2/2011 | Ojala | G10L 19/24 375/240 |
| 2011/0135007 | A1 * | 6/2011 | Vasilache | G10L 19/038 375/240.22 |
| 2013/0218578 | A1 | 8/2013 | Gao | |
| 2013/0246055 | A1 | 9/2013 | Gao | |
| 2014/0286399 | A1 * | 9/2014 | Valin | H04N 19/94 375/240.03 |
| 2016/0240203 | A1 * | 8/2016 | Lecomte | G10L 19/005 |
| 2017/0309279 | A1 * | 10/2017 | Samuelsson | G10L 19/0017 |

FOREIGN PATENT DOCUMENTS

| | | | |
|---|---|---|---|
| CN | 1815894 | A | 8/2006 |
| CN | 101911501 | A | 12/2010 |
| EP | 0658873 | A1 | 6/1995 |
| EP | 0704836 | A2 | 4/1996 |
| EP | 0785419 | A2 | 7/1997 |
| EP | 0831457 | A2 | 3/1998 |
| EP | 1024477 | A1 | 8/2000 |
| EP | 1785985 | A1 | 5/2007 |
| JP | H09120297 | A | 5/1997 |
| WO | 2003/103151 | A1 | 12/2003 |
| WO | 2009/100768 | A1 | 8/2009 |

OTHER PUBLICATIONS

Ericsson LM et al. "Corrections to EVS Fixed-Point Source Code", 3GPP Draft; S4-150625_CR26442-0010_Corrections, 3rd Generation Partnership Project (3GPP), Mobile Competence Centre; 650 Route Des Lucioles; F-06921 Sophia-Antipolis Cedex; France; vol. SA WG4, no. Rennes, France; Jul. 6, 2015-Jul. 10, 2015 Jun. 30, 2015.

Vasilache et al. "Indexing of Lattice Codevectors Applied to Error Resilient Audio Coding", Conference: 30th International Conference: Intelligent Audio Environments; Mar. 2007, AES 60 East 42nd Street, Rm 2520 New York 10165-2520, USA, Mar. 1, 2007.

"Universal Mobile Telecommunications System (UMTS); LTE; Codec for Enhanced Voice Services (EVS); Detailed algorithmic description (3GPP TS 26.445 version 12.1.0 Release 12)", Technical Specification, European Telecommunications Standards Institute (ETSI), 650 Route Des Lucioles; F-06921 Sophia-Antipolis; France, vol. 3GPP SA 4, No. V12.1.0, Mar. 1, 2015.

Vasilache A. et al. "Robust indexing of lattices and permutations codes over binary symmetric channels", Signal Processing, Elsevier, Science Publishers B.V. Amsterdam, NL, vol. 83 No. 7, Jul. 1, 2003.

Office action received for corresponding European Patent Application No. 11868944.7, dated Apr. 30, 2018, 5 pages.

"3rd Generation Partnership Project; Technical Specification Group Services and System Aspects; Codec for Enhanced Voice Services (EVS); ANSI C code (fixed-point) (Release 12)", 3GPP TS 26.442, V12.0.0, Sep. 2014, pp. 1-9.

Office action received for corresponding Indian Patent Application No. 142/CHENP/2014, dated Oct. 15, 2018, 7 pages.

Office action received for corresponding Canadian Patent Application No. 2991341, dated Nov. 21, 2018, 4 pages.

Vasilache et al., "Multiple-Scale Leader-Lattice VQ With Applications to LSF Quantization", Institute of Signal Processing, Tampere University of Technology, vol. 82, Issue Apr. 4, 2002, pp. 563-586.

International Search Report and Written Opinion received for corresponding Patent Cooperation Treaty Application No. PCT/IB2011/001541, dated May 14, 2012, 13 pages.

International Search Report and Written Opinion received for corresponding Patent Cooperation Treaty Application No. PCT/FI2011/050998, dated Aug. 30, 2012, 14 pages.

Jelinek et al., "Wideband speech coding advances in VMP-WB standard," IEEE Transactions on Audio, Speech, and Language processing, vol. 15, No. 4, May 2007, pp. 1167-1179.

Extended European Search Report received for corresponding European Patent Application No. 11875412.6, dated Jun. 8, 2015, 6 pages.

Notice of Allowance received for corresponding U.S. Appl. No. 14/128,859, dated Aug. 14, 2015, 8 pages.

Office action received for corresponding Chinese Patent Application No. 201180072049.2, dated Jan. 12, 2016, 7 pages of office action and no page of translation available.

Extended European Search Report received for corresponding European Patent Application No. 11868944.7, dated Feb. 18, 2016, 9 pages.

Jiang et al., "An Efficient Training Algorithm Design for General Competitive Learning Neural Networks", Proceedings IWISP '96, Nov. 4-7, 1996, pp. 15-17.

Non-Final Office action received for corresponding U.S. Appl. No. 14/357,210, dated Feb. 24, 2016, 14 pages.

Decision to grant received for corresponding European Application No. 11875412.6, dated Apr. 7, 2016, 7 pages.

Office action received for corresponding Chinese Patent Application No. 201180072049.2, dated Jun. 29, 2016, 3 pages of office action and no page of translation available.

"Universal Mobile Telecommunications System (UMTS); LTW; Codec for Enhanced Voice Services (EVS); Detailed algorithmic description (33GPP TS 26.445 version 12.1.0 Release 12)", Technical Specification, European Telecomunications Standards Institute (ETSI), 650 Route Des Lucioles; F-06921 Sophia-Antipolis; France, vol. 3GPP SA4, No. V12.1.0, Mar. 1, 2015.

Office action received for corresponding Japanese Patent Application No. 2018-500363, dated Feb. 26, 2019, 2 pages of office action and 6 pages of translation available.

Office Action for European Application No. 15733775.9 dated May 22, 2019.

* cited by examiner

BIT ERROR DETECTOR FOR AN AUDIO SIGNAL DECODER

RELATED APPLICATION

This application was originally filed as PCT Application No. PCT/EP2015/065396 filed Jul. 6, 2015.

FIELD

The present application relates to a bit error detector within a multichannel or stereo audio signal decoder, and in particular, but not exclusively to an Enhanced Voice Service audio signal decoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise). These types of coders typically do not utilise a speech model for the coding process, rather they use processes for representing all types of audio signals, including speech. Speech encoders and decoders (codecs) can be considered to be audio codecs which are optimised for speech signals, and can operate at either a fixed or variable bit rate.

Audio encoders and decoder are often designed as low complexity source coders. In other words able to perform encoding and decoding of audio signals without requiring highly complex processing.

An example of which is transform coding. For music signal audio encoding transform coding generally performs better than Algebraic Code Excited Linear Prediction (ACELP) technology which is better suited and directed for speech signals. Transform coding is performed by coding transform coefficients vector sub-band wise. In other words an audio signal is divided into sub-bands for which a parameter is determined and the parameters represent sub-vectors which are vector or lattice quantised.

Furthermore low complexity algorithms for speech and audio coding constitute a very relevant asset, for instance for mobile terminal based communications. Due to low storage and low complexity, while preserving coding efficiency, structured codebooks may be preferred in several state of the art speech and audio codecs, like for instance the Enhanced Voice Service (EVS) codec standardized within the Third Generation Partnership Project (3GPP).

Codebooks used within these speech and audio codecs may for instance be based on lattice structures, as described in reference "Multiple-scale leader-lattice VQ with application to LSF quantization" by A. Vasilache, B. Dumitrescu and I. Tabus, Signal Processing, 2002, vol. 82, pages 563-586, Elsevier, which is incorporated herein in its entirety by reference.

It is possible to define a lattice codebook as a union of leader classes, each of which is characterized by a leader vector. A leader vector is an n-dimensional vector (with n denoting an integer number), whose (e.g. positive) components are ordered (e.g. decreasingly). The leader class corresponding to the leader vector then consists of the leader vector and all vectors obtained through all the signed permutations of the leader vector (with some possible restrictions). It is also possible that one, some or all leader classes are respectively associated with one or more scales, and the lattice codebook is then formed as a union of scaled and/or unscaled leader classes.

SUMMARY

According to a first aspect there is provided a method comprising: receiving lattice vector quantised parameter data, the parameter data representing at least one audio signal; determining within the data at least one bit error; and controlling the decoding of the data to generate an audio signal based on the determining of the bit error.

Determining within the data at least one bit error may comprise: determining, from the lattice vector quantised parameter data, the index integer values forming an index; determining that at least one of the index integer values forming the index is strictly negative; and generating an indicator that the data comprises at least one bit error.

Determining within the data at least one bit error may comprise: determining from the data a combined index value I; dividing the combined index value I by at least one combination of cardinality of a union of leader classes for at least one subvector other than a first subvector employed in the lattice vector quantization of the parameter values representing the at least one audio signal to generate at least two sub-indexes associated with sub-vectors of the quantized parameter values; determining the most-significant sub-index comprises a value greater than the cardinality of a union of leader classes $N_1$ for the first subvector; and generating an indicator that the data comprises at least one bit error.

Determining within the data at least one bit error may comprise: determining the data represents a comfort noise generation audio frame; determining a defined parameter component value; determining the defined parameter component value is greater than a defined limit value, wherein the defined parameter component value being greater than a defined limit value indicates an internal sampling rate of the decoder; determining a signalling bit indicating a value of the internal sampling rate of the decoder; determining the internal sampling rate of the decoder based on the defined parameter component value does not match the internal sampling rate of the decoder based on the signalling bit; and generating an indicator that the data comprises at least one bit error.

The defined parameter component value may be a last or highest frequency quantized parameter.

The defined parameter component value may be a highest order quantized parameter.

Controlling the decoding of the data to generate an audio signal based on the determining of the bit error may comprise setting a codevector associated with the data to a defined value.

Setting the codevector associated with the data to a defined value may comprise setting the codevector to zero, The parameter may be a line spectral frequency.

According to a second aspect there is provided a decoder comprising: an input configured to receive lattice vector quantised parameter data, the parameter data representing at least one audio signal; a bit error determiner configured to determine within the data at least one bit error; and a parameter decoder configured to control the decoding of the data to generate an audio signal based on the determining of the bit error.

The bit error determiner may comprise an index integer determiner configured to: determine, from the lattice vector quantised parameter data, the index integer values forming an index; determine that at least one of the index integer values forming the index is strictly negative; and generate an indicator that the data comprises at least one bit error.

The bit error determiner may comprise a subvector index comparator configured to: determine from the data a combined index value I; divide the combined index value I by at least one combination of cardinality of a union of leader classes for at least one subvector other than a first subvector employed in the lattice vector quantization of the parameter values representing the at least one audio signal to generate at least two sub-indexes associated with sub-vectors of the quantized parameter values; determine the most-significant sub-index comprises a value greater than the cardinality of a union of leader classes $N_1$ for the first subvector; and generate an indicator that the data comprises at least one bit error.

The bit error determiner may comprise a sampling rate bit comparator configured to: determine the data represents a comfort noise generation audio frame; determine a defined parameter component value; determine the defined parameter component value is greater than a defined limit value, wherein the defined parameter component value being greater than a defined limit value indicates an internal sampling rate of the decoder; determine a signalling bit indicating a value of the internal sampling rate of the decoder; determine the internal sampling rate of the decoder based on the defined parameter component value does not match the internal sampling rate of the decoder based on the signalling bit; and generate an indicator that the data comprises at least one bit error.

The defined parameter component value may be a last or highest frequency quantized parameter.

The defined parameter component value may be a highest order quantized parameter.

The parameter decoder may be configured to set a codevector associated with the data to a defined value based on the determining of the bit error.

The defined value may be zero.

The parameter may be a line spectral frequency.

According to a third aspect there is provided an apparatus comprising: means for receiving lattice vector quantised parameter data, the parameter data representing at least one audio signal; means for determining within the data at least one bit error; and means for controlling the decoding of the data to generate an audio signal based on the determining of the bit error.

The means for determining within the data at least one bit error may comprise: means for determining, from the lattice vector quantised parameter data, the index integer values forming an index; means for determining that at least one of the index integer values forming the index is strictly negative; and means for generating an indicator that the data comprises at least one bit error.

The means for determining within the data at least one bit error may comprise: means for determining from the data a combined index value I; means for dividing the combined index value I by at least one combination of cardinality of a union of leader classes for at least one subvector other than a first subvector employed in the lattice vector quantization of the parameter values representing the at least one audio signal to generate at least two sub-indexes associated with sub-vectors of the quantized parameter values; means for determining the most-significant sub-index comprises a value greater than the cardinality of a union of leader classes $N_1$ for the first subvector; and means for generating an indicator that the data comprises at least one bit error.

The means for determining within the data at least one bit error may comprise: means for determining the data represents a comfort noise generation audio frame; means for determining a defined parameter component value; determining the defined parameter component value is greater than a defined limit value, wherein the defined parameter component value being greater than a defined limit value indicates an internal sampling rate of the decoder; means for determining a signalling bit indicating a value of the internal sampling rate of the decoder; means for determining the internal sampling rate of the decoder based on the defined parameter component value does not match the internal sampling rate of the decoder based on the signalling bit; and means for generating an indicator that the data comprises at least one bit error.

The defined parameter component value may be a last or highest frequency quantized parameter.

The defined parameter component value may be a highest order quantized parameter.

The means for controlling the decoding of the data to generate an audio signal based on the determining of the bit error may comprise means for setting a codevector associated with the data to a defined value.

The means for setting the codevector associated with the data to a defined value may comprise means for setting the codevector to zero.

The parameter may be a line spectral frequency.

A computer program product may cause an apparatus to perform the method as described herein.

An electronic device may comprise apparatus as described herein.

A chipset may comprise apparatus as described herein.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

Figure 1:
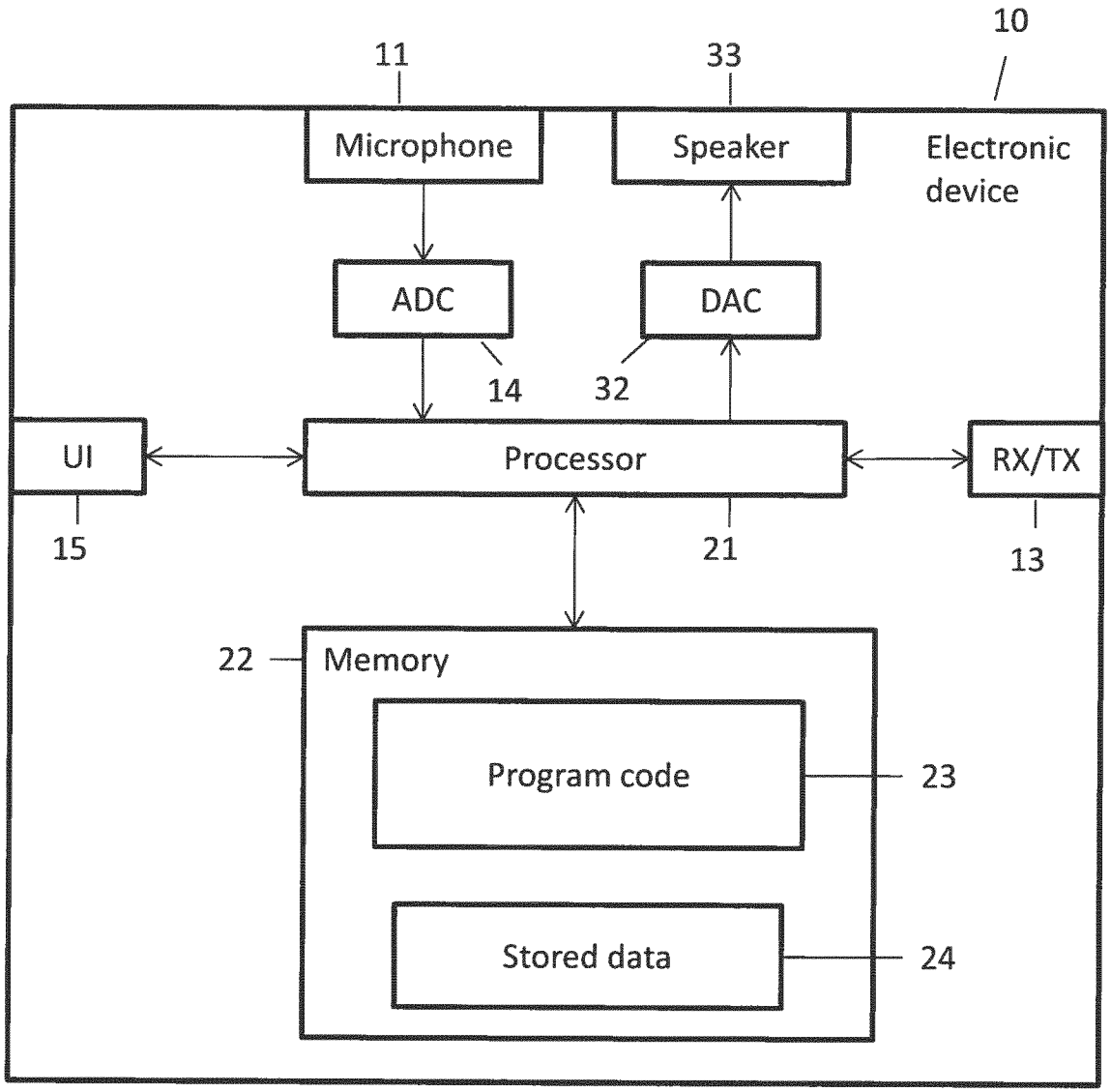
FIG. 1 shows schematically an electronic device employing some embodiments.

The following describes in more detail possible stereo and multichannel speech and audio codecs, including layered or scalable variable rate speech and audio codecs.

The EVS codec has been primarily developed for frame loss errors type, which are characteristic for packet switched (PS) networks. Within this context bit errors, i.e. one or more bits in the bitstream being flipped, were not possible. Within the circuit switched (CS) network this assumption does no longer hold and these errors need to be handled.

Normally the number of codevectors, or cardinality, in a codebook is a power of two, making it impossible to determine bit errors. The concept thus in some embodiments as discussed herein is to exploit the information that for lattice codebooks, the cardinality of a codebook is not a power of two, and so bit errors can be detected when invalid indexes are read by comparing the value of the index with the codebook's cardinality.

Furthermore as discussed herein the embodiments propose multiple approaches for detecting bit errors in encoding characteristics such a line spectral frequencies (LSF's) in the EVS codec. One approach is based on determining subparts or subvectors of the lattice codevector index, because the index is not available in its integer form. A further approach may be applied for LSF decoding in a comfort noise generation scenario and relies on the particular structure of the first stage codebook, covering multiple internal sampling rates (such as 12.8 kHz and 16 kHz).

The LSF parameters as discussed herein may be encoded using a multistage approach, whose last stage is formed by a multiple scale lattice vector quantizer (MSLVQ). In some examples the MSLVQ is a one multistage quantizer for each 8 dimensional subvector of the 16-dimensional LSF vector. Furthermore all stages of the multistage quantizer may use a given amount of bits, depending on the signal type. While the VQ optimized stages make use of all the bits that are allotted to them, the last MSLVQ stage does not use exactly the amount of bits, B, available in the sense that the number of codevectors for the last stage, $N_{cv}$ is such that $2^{B-1}<N_{cv}<=2^{B}$. This constraint comes from the fact that the cardinalities of the lattice leaders classes or the union of lattice leader classes are not exactly powers of two. This difference can be exploited in order to signal and determine bit errors in the codevector indexes when indexes larger than the cardinality of the considered union of leader classes are received.

In some embodiments the number of bits allotted for the last MSLVQ stage is larger than 16, or even larger than 32. The bitstream thus in some embodiments may be formed by integers of 16 bits, therefore the index is received as a sequence of 16 bit integers. If the index could be determined as its real value, its validity may be assessed by comparing it with the number of total codevectors available for the 16 dimensional residual vector. However such an approach requires a calculation of the number of total codevectors available for the 16 dimensional residual vector, i.e. it is not used as such in the codec. Calculating both these numbers would increase the computational complexity and/or significantly add to the look-up table stored in ROM.

In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise an audio encoding or decoding or bit error detecting code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented at least partially in hardware and/or firmware.

The user interface (UI) 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver (RX/TX) 13 suitable for enabling communication with other apparatus, for example via a wireless communication network.

The transceiver 13 can communicate with further devices by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22. A corresponding application in some embodiments can be activated to this end by the user via the user interface 15. The formatting and encoding of the audio signals in some embodiments can be performed by the processor 21, using the encoding code stored in the memory 22. Although in the following examples the microphone 11 is configured to generate the audio signals for inputting it would be understood that the input audio signals can be received from any suitable input such as from the memory 22 and specifically within the stored data 24 section of the memory 22. In some embodiments the input audio signal or at least one audio signal can be received via the transceiver 13. For example the transceiver 13 can be configured to receive audio signals generated by microphones external to the apparatus 10, for example a Bluetooth device coupled to the apparatus via the transceiver 13.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

The processor 21 in such embodiments then processes the digital audio signal in the same way as described with reference to the system shown in FIG. 2, and specifically the encoder shown in FIG. 3, and the decoder shown in FIGS. 4 and 5 and details of the encoder shown in FIGS. 6 to 8.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

Figure 3:
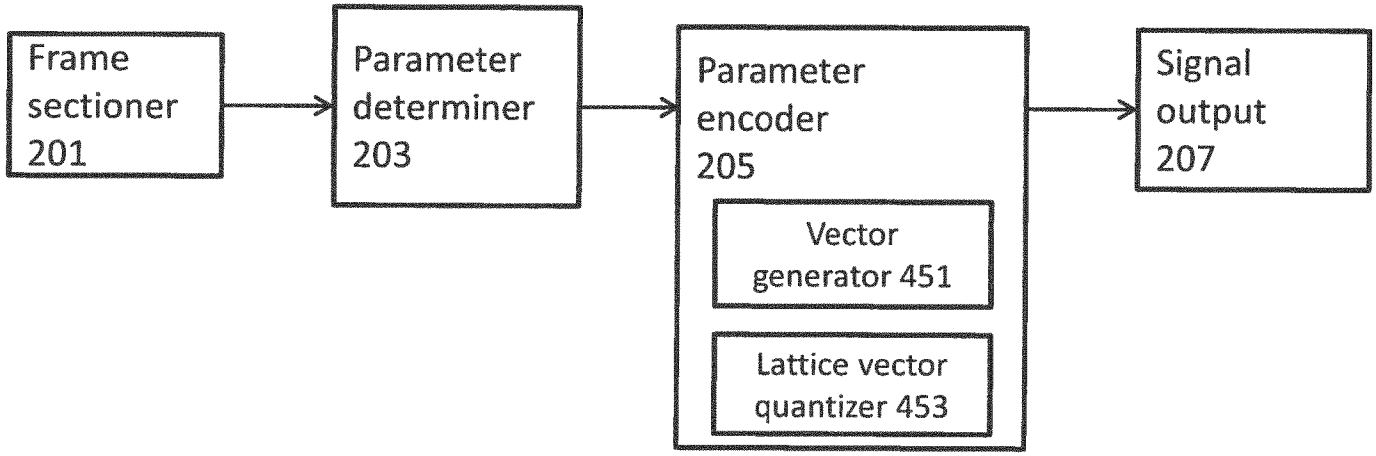
FIG. 3 shows schematically an encoder as shown in FIG. 2 according to some embodiments.

It would be appreciated that the schematic structures described in FIG. 3 represent only a part of the operation of an audio codec and specifically part of an audio encoder apparatus or method as exemplarily shown implemented in the apparatus shown in FIG. 1. Similarly the schematic structures shown in FIGS. 4 and 5 and the method steps shown in FIGS. 6 to 8 represent only a part of the operation of an audio codec and specifically part of an audio decoder apparatus or method as exemplarily shown implemented in the apparatus shown in FIG. 1.

Figure 2:
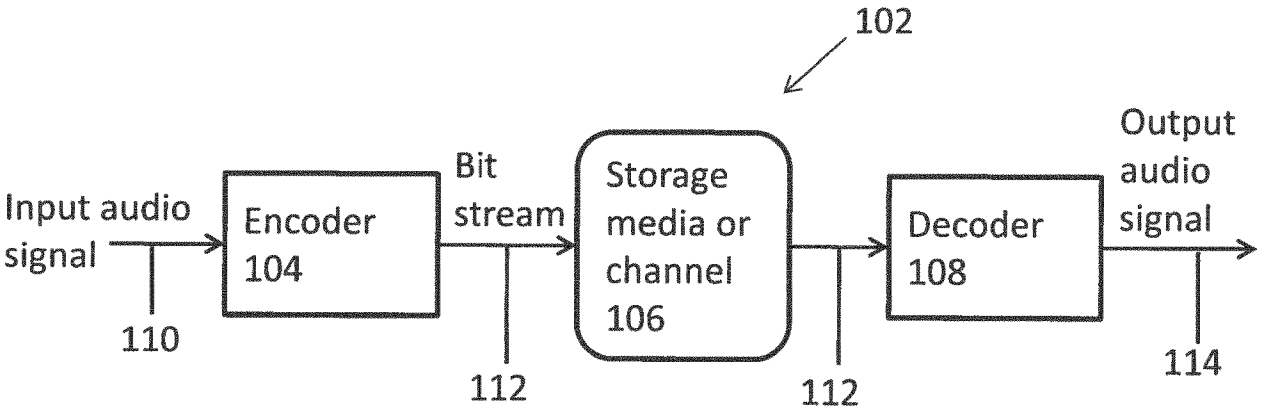
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104, a storage or media channel 106 and a decoder 108. It would be understood that as described above some embodiments can comprise or implement one of the decoder 108 or both the encoder 104 and decoder 108.

The encoder 104 compresses an input audio signal 110 producing a bit stream 112, which in some embodiments can be stored or transmitted through a media channel 106. The encoder 104 can in some embodiments comprise a multichannel encoder that encodes two or more audio signals.

The bit stream 112 can be received within the decoder 108. The decoder 108 decompresses the bit stream 112 and produces an output audio signal 114. The decoder 108 can comprise a transform decoder as part of the overall decoding operation. The decoder 108 can also comprise a multichannel decoder that decodes two or more audio signals. The bit rate of the bit stream 112 and the quality of the output audio signal 114 in relation to the input signal 110 are the main features which define the performance of the coding system 102.

FIG. 3 shows schematically the encoder 104 according to some embodiments.

The concept for the embodiments as described herein is to determine and apply encoding to audio signals to produce efficient high quality and low bit rate real life coding. To that respect with respect to FIG. 3 an example encoder 104 is shown according to some embodiments. In the following examples the encoder is configured to generate frequency domain parameters representing the audio signal and encode the generated frequency domain parameters using a suitable vector lattice quantization, however it would be understood that in some embodiments the parameters used in the lattice quantization as described herein can be any suitable parameters defining or representing the audio signals or other type of signals (for example image or, video). Similarly variations of lattice quantization methods other than those described herein may be employed to encode the audio signals.

The encoder 104 in some embodiments comprises a frame sectioner 201 or suitable means for sectioning the audio signal. The frame sectioner 201 is configured to receive the audio signals (for example a mono, left and right stereo or any multichannel audio representation) input audio signal and section or segment the audio signal data into sections or frames suitable for frequency or other domain transformation. The frame sectioner 201 in some embodiments can further be configured to window these frames or sections of audio signal data according to any suitable windowing function. For example the frame sectioner 201 can be configured in some embodiments to generate frames of 20 ms which overlap preceding and succeeding frames by 10 ms each.

In some embodiments the audio frames can be passed to a parameter determiner 203.

In some embodiments the encoder comprises a parameter determiner 203 of suitable means for determining at least one parameter representing the input audio signal(s) or input audio signal frames. In the following examples the parameter is a line spectral frequency (LSF) parameter however it would be understood that in some embodiments any suitable parameter can be determined.

For example in some embodiments the parameter determiner comprises a transformer 203 or suitable means for transforming. The transformer 203 in some embodiments is configured to generate frequency domain (or other suitable domain) parameter representations of these audio signals. These frequency domain parameter representations can in some embodiments be passed to the parameter encoder 205.

In some embodiments the transformer 203 can be configured to perform any suitable time to frequency domain transformation on the audio signal data. For example the time to frequency domain transformation can be a discrete Fourier transform (DFT), Fast Fourier transform (FFT), modified discrete cosine transform (MDCT). In the following examples a Fast Fourier Transform (FFT) is used.

Furthermore the transformer can further be configured to generate separate frequency band domain parameter representations (sub-band parameter representations) of each input channel audio signal data. These bands can be arranged in any suitable manner. For example these bands can be linearly spaced, or be perceptual or psychoacoustically allocated. The parameters generated can be any suitable parameter.

In some embodiments the representations, such as LSF parameters, are passed to a parameter encoder 205.

In some embodiments the encoder 104 can comprise a parameter encoder 205. The parameter encoder 205 can be configured to receive the parameter representations of the audio signal input, for example the determined LSF parameters. The parameter encoder 205 can furthermore in some embodiments be configured to use each of the LSF parameter values as a sub-vector and combine each sub-vector to create a vector to input into a vector quantizer. In other words the apparatus can comprise a vector generator configured to generate a first vector of parameters (or tuples of a first vector representing the parameters) defining at least one audio signal. In the following examples the parameter is the linear spectral frequency, however it may in further embodiments be any other suitable frequency derived parameter.

The output of the vector quantizer is in some embodiments the encoder and therefore the vector quantized audio signals output are the 'encoded' or parameter encoded representations of the audio signal.

In some embodiments the parameter encoder 205 comprises a vector generator 451. The vector generator 451 is configured to receive the LSF parameters and generate an N dimensional vector from these values.

The generated vectors can in some embodiments be passed to the lattice vector quantizer 453.

In some embodiments the parameter encoder 205 comprises a lattice vector quantizer 453. The lattice vector quantizer 453 receives the input vector generated from the LSF parameters and generates a nearest neighbour or NN output which occurs within a defined lattice and thus can be decoded using a similar lattice at the decoder.

The lattice quantizer can in some embodiments be defined by respective program code 23 of a computer program that is stored on a tangible storage medium memory 22.

Before introducing the concepts and embodiments with respect to the invention we shall initially discuss conventional lattice vector quantization. In some lattice quantizers an initial generating or determining a set of potential basis code vectors, wherein each determined potential basis code vector of this set of potential basis code vectors is associated with a potential basis code vector of a different set of basis code vectors is performed.

Each set of potential basis code vectors comprises at least one basis code vector. Since each set of basis code vectors is associated with at least one scale representative of a plurality of scale representatives, a code vector can be determined based on a basis code vector of a set of potential basis code vectors and a scale representative of the at least one scale representative associated with the set of potential basis code vectors. In other words the code vector may be represented based on a basis code vector scaled by the respective scale representative. For instance, the scale representative may represent a scale value, wherein a code vector may be determined based on a multiplication of a basis code vector and the respective scale value. Furthermore in some embodiments the codebook is obtained by applying a (signed) permutation of the basis vector.

For instance, at least one set of basis code vectors is associated with at least two scale representatives.

Accordingly, as an example, a codebook may comprise a set of code vectors comprising code vectors based on the plurality of sets of basis code vectors and based on the respective at least one scale value associated with a respective set of basis code vectors of the plurality of basis code vectors. This set of code vectors may comprise, for each basis code vector of each set of basis code vectors and for each of the at least one scale representative associated with a respective set of basis code vectors, a code vector based on the respective basis code vector scaled by the respective scale representative.

For instance, said sets of basis code vectors may represent leader classes, wherein each leader class comprises a different leader vector and permutations of said leader vector. Thus, said leader vector and the permutations of said leader vector may represent the basis code vectors of the respective set of basis code vectors.

The plurality of sets of basis code vectors may represent a subset of a second plurality of sets of basis code vectors. For instance, under the assumption that each set of basis code vector represents a leader class, the plurality of leader classes may represent a subset of a second plurality of leader classes. Thus, the plurality of leader classes may be considered as a truncated plurality of leader classes with respect to the second plurality of leader classes.

For instance, the respective potential basis code vector may be determined by determining the basis code vector of the at least one basis code vector of the respective set of basis code vector which is nearest to the input vector to be encoded. Any kind of suitable criterion may be used for finding the nearest basis code vector with respect to the input vector to be encoded.

As an example, a potential basis code vector may be determined based on a nearest basis code vector with respect to the absolute valued input vector and based on information of signs of the values of the input vector, wherein this information may comprise the sign of a respective position of respective values in the input vector and is used to assign signs to values of the determined potential basis code vector. Furthermore, as an example, the basis code vector which is nearest to the absolute valued input vector may be determined, wherein the absolute valued input vector comprises absolute values corresponding to the values of the input vector, wherein the potential basis code vector represents the determined nearest basis code vector, wherein the signs of the values of the potential basis code vector correspond to the signs of the values of the input vector at the same position in the vector, wherein this may hold if the parity of the basis code vectors of the set of basis code vectors is 0. As another example, if the parity of the basis code vectors of the set of basis code vectors is −1, the signs of the values of the potential basis code vector may be assigned corresponding to the signs of the values of the input vector at the same position in the vector, respectively, and if there are not an odd number of negative components, the value in the potential basis code vector having the lowest non-null absolute value may change its sign. Or, as another example, if the parity of the basis code vectors of the set of basis code vectors is +1, the signs of the values of the potential basis code vector may be assigned corresponding to the signs of the values of the input vector at the same position in the vector, respectively, and if there are not an even number of negative components, the value in the potential basis code vector having the lowest non-null absolute value may change its sign.

The code vector for encoding the input vector is then conventionally determined based on the set of determined potential code vectors, wherein said set of determined potential code vectors defines a subset of code vectors, said subset of code vectors comprising, for each determined potential basis code vector and each scale representative associated with the set of basis code vectors of the respective potential basis code vector, a code vector based on the respective potential basis code vector scaled by the respective scale representative.

Accordingly, the search for the code vector for encoding the input vector has been performed in the subset of code vectors defined by the determined potential code vectors and defined by the respective at least one scale representative associated with the set of basis code vectors of the respective determined potential code vector. Since this subset of code vectors may represent a subset of code vectors associated with the codebook, the number of code vectors of this subset of code vectors may be less than the number of code vectors of the set of code vectors.

As an example, each scale representative of the plurality of scale representatives may be associated with at least one set of code vectors, wherein each set of code vectors of said at least one set of code vectors associated with a respective scale representative is associated with a set of basis code vectors of the plurality of sets of basis code vectors such that each set of code vectors of said at least one set of code vectors associated with a respective scale representative comprises code vectors obtained by scaling the basis vectors of the associated respective set of basis vectors with the respective scale representative.

Accordingly, the code vectors of the at least one set of basis code vectors associated with a respective scale representative of the plurality of scale representatives can be determined based on scaling the basis code vectors of each set of basis code vectors associated with the scale representative with this scale representative.

For instance, in case said sets of basis code vectors represent leader classes, the at least one set of basis code vectors associated with a respective scale representative may be considered as a union of leader classes. It would be understood that usually the union of leader classes is independent of the scale. Thus, the codebook may comprise at last one union of leader classes, wherein each union of leader class is associated with one of at least one scale representatives and with at least one set of basis code vectors of the plurality of basis code vectors. As an example, the at least one scale representative may represent the plurality of scale representatives which may comprise at least two scale representatives.

Thus for example $b_x$, with $x \in \{0, 1, \ldots X-1\}$, represents a set of basis code vectors of the plurality of sets of basis code vectors, wherein X represents the number of sets of the plurality of sets of basis code vectors. Each set of basis code vectors is associated or comprises at least one basis code vector $b_{x,y}$, wherein $B_x$ represents the number of basis code vectors of a respective set of basis code vectors $b_x$, i.e. $y \in \{0, 1, \ldots B_x-1\}$ holds. For instance, the number $B_x$ of basis code vectors of a set of basis code vectors may be different for different sets of basis code vectors and/or it may be the same for at least two sets of basis code vectors.

In other words a leader vector is just one vector. Together with all the signed permutations of the leader vector then this set forms the leader vector's leader class (or as described herein the basis code vectors). When putting together several leader classes, a union of leader classes is formed. Then to this union/unions one or more scales can be attached.

Thus for example it may be possible to determine a code vector $c_{x,z,y}$ based on basis code vector $b_{x,y}$ and based on a scale representative $s_z$, wherein index z represents the index of the respective scale representative of the plurality of scale representatives $s_0 \ldots s_{S-1}$, i.e. $z \in \{0, 1, \ldots S-1\}$ holds.

For instance, in case the values $b_{x,y,t}$ of the basis code vectors $b_{x,y}=[b_{x,y,0}, b_{x,y,n}, \ldots, b_{x,y,n-1}]$ represent absolute values, wherein $t \in \{0, 1, \ldots n-1\}$ holds and n represents the length of the respective basis code vector $b_{x,y}$, and if the absolute valued input vector is used for determining the potential code vector of a respective set of basis code vectors, the sign of each value $b_{x,y,t}$ at the (t+1)th position of the determined nearest basis code vector $b_{x,y}$ may be assigned based on the sign of the respective value $i_t$ at the (t+1)th position of the input vector i, before determining a code vector $c_{x,z,y}$ based on basis code vector $b_{x,y}$ and based on a scale representative $s_z$ is performed.

As an example, if $i=[i_0, i_1, \ldots, i_{n-1}]$ represents the input vector, the absolute valued input vector may be represented by $[|i_0|, |i_1|, \ldots, |i_{n-1}|]$. For instance, the sign of each value $b_{x,y,t}$ at the (t+1)th position of the determined nearest basis code vector $b_{x,y}$ may be assigned to the sign of the respective value $i_t$ at the (t+1)th position of the input vector, respectively, wherein this may hold if the parity of the basis code vectors $b_{x,y}$ of the set of basis code vectors $b_x$ is 0. As another example, if the parity of the basis code vectors $b_{x,y}$ of the set of basis code vectors $b_x$ is −1, the signs of the values $b_{x,y,t}$ of the potential basis code vector may be assigned corresponding to the signs of the values of the input vector at the same position in the vector, respectively, and if there are not an odd number of negative components, the value $b_{x,y,t}$ in the potential basis code vector having the lowest non-null absolute value may change its sign. Or, as another example, if the parity of the basis code vectors $b_{x,y}$ of the set of basis code vectors $b_x$ is +1, the signs of the values $b_{x,y,t}$ of the potential basis code vector may be assigned corresponding to the signs of the values of the input vector at the same position in the vector, respectively, and if there are not an even number of negative components, the value $b_{x,y,t}$ in the potential basis code vector having the lowest non-null absolute value may change its sign.

As a non-limiting example, a code vector $c_{x,z,y}$ may be determined by $c_{x,z,y}=[b_{x,y,0} \cdot S_z, b_{x,y,1} \cdot S_z, \ldots, b_{x,y,n-1} \cdot S_z]$.

Each of the scale representatives $s_z$, wherein $z \in \{0, 1, \ldots S-1\}$ holds, is associated with at least one set of basis code vectors. For instance, as a non-limiting example this respective at least one set of basis code vectors may be represented by the set of basis code vectors $b_x$, with $x \in \{0, 1, \ldots n_z-1\}$, wherein $n_z$ may represent the number of sets of basis code vectors associated with the respective scale representative $s_z$, wherein $0<n_z<X$ holds. Based on this linkage between a respective scale representative $s_z$ and the associated at least one set of basis code vectors $b_x$, with $x \in \{0, 1, n_z-1\}$, the associated at least one set of code vectors $c_{x,z,y}$, with $x \in \{0, 1, \ldots n_z-1\}$ and $y \in \{0, 1, \ldots B_x-1\}$ and $z \in \{0, 1, \ldots S-1\}$, can be determined.

Thus, as an example, a codebook structure of the above mentioned codebook may be defined by the plurality of scale representatives $s_z$, the plurality of sets of basis code vectors $b_x$, and the linkage between each scale representative with the associated at least one set of basis code vectors.

Since at least one set of basis code vectors, e.g. at least the set of basis code vectors $b_0$, is associated with at least two scale representatives, the same set of basis code vectors can be used to construct code vectors of the at least one set of code vectors associated with a first scale representative and to construct code vectors of the at least one set of code vectors associated with at least one further scale representative.

It is possible to determine, for each set of basis code vectors of a plurality of sets of basis code vectors, a potential basis code vector for encoding an input vector in other ways.

For example determining a code vector for encoding the input vector from a subset of code vectors is based on a determined distortion metric or distance, or error value.

In such examples a scale representation of the plurality of scale representations is selected.

Furthermore the determined potential basis code vector of a set of basis code vectors associated with the selected scale representation is selected.

A code vector may then be determined based on the selected potential basis code vector and on the selected scale representation, wherein this determining of a code vector may be performed as described with respect to the method described herein.

In some examples based on the determined code vector and the input vector, a distortion metric is determined. For instance, said distortion metric may be based on any kind of suitable distance between the determined code vector and the input vector. As an example, a Hamming distance or an Euclidian distance or any other distance may be used. As an example, determining the code vector may be omitted and the distortion metric may be calculated by inherently considering the respective code vector associated with the selected scale representation and the set of basis code vectors associated with this selected scale representation.

For instance, if $c_{x,z,y}=[c_{x,z,y,0}, c_{x,z,1}, \ldots, c_{x,z,n-1}]$ represents the code vector and $i=[i_0, i_1, \ldots, i_{n-1}]$ represents the input vector, a distance d may be calculated based on $$d = \sum_{k=0}^{n-1} (i_k - c_{x,z,y,k})^2.$$

This distance d according to the equation above may be replaced with distance d' calculated based on $$d' = \sum_{k=0}^{n-1} c_{x,z,y,k}^2 - 2\sum_{k=0}^{n-1} i_k \cdot c_{x,z,y,k}$$

Or, as another example, in case the distortion metric is determined based on a weighting function, distance d according to equation above may be amended as follows:

$$d_w = \sum_{k=0}^{n-1} w_k \cdot (i_k - c_{x,z,y,k})^2,$$

wherein $w_k$ represent weighting factors of the weighting function.

Accordingly, distance d' according to the equation above may by weighted by means of the weighting function in the following way:

$$d'_w = \sum_{k=0}^{n-1} w_k \cdot c_{x,z,y,k}^2 - 2\sum_{k=0}^{n-1} w_k \cdot i_k \cdot c_{x,z,y,k}$$

For instance, the distortion metric d, or d', or $d_w$, or $d_w'$ may be stored, if it is the first determined distortion metric, or it may be compared with a stored distortion metric, wherein the stored distortion metric is replaced if the newly determined distortion metric is better than the stored distortion metric. Furthermore, the code vector associated with the stored distortion metric may be stored or an identifier of this code vector may be stored.

Then for example the operation can check whether there are any further sets of basis code vectors associated with the selected scale representation. If yes, then the determined potential basis code vector of this further set of basis code vectors associated with the selected scale representation is selected. If no there is a check made against further scale representation of the plurality of scale representations.

If there is a further scale representation of the plurality of scale representations, then the further scale representation is selected, otherwise the code vector associated with the best distance metric may be selected for encoding the input vector.

For instance, where the sets of basis code vectors may represent leader classes, wherein each leader class comprises a different leader vector and permutations of said leader vector. Thus, the leader vector and the permutations of said leader vector may represent the basis code vectors of the respective set of basis code vectors. As an example, a leader vector is an n-dimensional vector (with n denoting an integer number), whose (positive) components are ordered (e.g. decreasingly). The leader class corresponding to the leader vector then consists of the leader vector and all vectors obtained through all the signed permutations of the leader vector (with some possible restrictions).

A union of leader classes may be defined by the sets of basis code vectors associated with the same scale representation of the plurality of scale representations and the respective scale representation. For instance, a union of leader classes may be associated with a set of code vectors obtained by means of scaling the basis code vectors of the associated step of basis code vectors with the scale representative.

Such a union of leader classes may be considered as a truncation. Thus, if the plurality of scale representations are n scale representations, n unions of leader classes may be defined, wherein each union of leader class is defined by means of the respective scale representation and the sets of basis code vectors associated with the respective scale representation.

Accordingly, the plurality of scale representations and the plurality of sets of basis code vectors may define a plurality of union of leader classes thereby defining a codebook, wherein, as an example, each union of leader classes may be considered as a union of scaled leader classes.

Codebooks used within these speech and audio codecs may for instance be based on lattice structures, as described in reference "Multiple-scale leader-lattice VQ with application to LSF quantization" by A. Vasilache, B. Dumitrescu and I. Tabus, Signal Processing, 2002, vol. 82, pages 563-586, Elsevier, which is incorporated herein in its entirety by reference. For instance, a $D_{10}^+$ lattice may be considered for quantization, but any other well-suited lattice quantization may also be considered.

For instance the sets of basis code vectors are leader classes, wherein each leader class comprises a different leader vector and permutations of said leader vector, and wherein each leader vector represents an n-dimensional vector comprising n absolute values arranged in a descending or an ascending order.

The leader vector l of the respective set of basis code vectors $b_x$ may be represented by $l=[l_0, l_1, \ldots, l_{n-1}]$, wherein $l_0$, $l_{n-1}$ are absolute values. In case of a descending order $l_0$ represents the 1-highest value, $l_1$ represents the 2-highest value and $l_{n-1}$ represents the n-highest value. In case of an ascending order $l_0$ represents the 1-lowest value, $l_1$ represents the 2-lowest value and $l_{n-1}$ represents the n-lowest value.

The value $l_{k-1}$ of the respective leader vector, which represents the value at kth position in the respective leader vector, can be assigned to a position in the potential basis code vector which corresponds to the position of the k-highest absolute value (in case of a descending ordered leader vector) or to the position of the k-lowest absolute value (in case of an ascending ordered leader vector) in the input vector. For instance, this position may be denoted as position m. As an example, the potential basis code vector may be represented by $p=[p_0, p_1, \ldots, p_{n-1}]$.

For instance, as a non-limiting example, an exemplary input vector may be i=[−2.4, 5.0, −1.3, 0.2], wherein the corresponding absolute valued input vector may be ia=[2.4, 5.0, 1.3, 0.2].

In case of the descending order of the leader vector, the value in position k of the leader vector, i.e. value $l_{k-1}$, is assigned to a position in the potential basis code vector which corresponds to the position of the k-highest absolute value in the input vector. For instance, starting with the first position represented by counter k=1, the position of the 1-highest absolute value in the input vector is position m=2, since value 5.0 is the 1-highest value in the absolute valued input vector and is located in position m=2, i.e. $ia_1$. Accordingly, value $l_0$ is assigned to the position m=2 in the potential basis code vector, i.e. $p_1=l_0$ may hold.

Furthermore, the sign (+ or −) of the assigned value in the potential basis code vector $p_{m-1}$ is set in accordance with the sign of the value of the input vector associated with the k-highest absolute value. Accordingly, $$p_{m-1}=l_{k-1}\cdot\mathrm{sign}(i_{m-1})$$

may hold.

Thus, in the non-limiting example of an exemplary input vector i=[−2.4, 5.0, −1.3, 0.2], $p_1=l_0$ may hold since value $i_1=5.0$ has a positive sign.

The position counter k may be incremented, and it may be checked whether there is another value in the leader vector, i.e. whether k≤n holds.

If yes, the method proceeds and in the non-limiting example, with respect to position k=2, value 2.4 at position m=1 represents the 2-highest (k-highest) absolute value in the input vector. Thus, $$P_0=l_1\cdot\mathrm{sign}(i_0)=-l_1$$

may hold for assigning $l_1$ with the respective sign, since value $i_0=-2.4$ in the input vector has a negative sign.

In this way, for the non-limiting example, the loop may iterate through the positions of the leader vector in the following way:

$$k=3\rightarrow m=3\rightarrow P_2=l_2\cdot\mathrm{sign}(i_2)=-l_2;\text{ and}$$

$$k=4\rightarrow m=4\rightarrow P_3=l_3\cdot\mathrm{sign}(i_3)=+l_3$$

Accordingly, the respective potential code vector obtained by the example method may result in $p=[-l_1, l_0, -l_2, l_3]$ in case of the descending ordered respective leader vector l.

If the leader vector l is ordered in an ascending way, then the method described above may be performed with m representing the position of the k-lowest value in the absolute valued input vector, wherein $p_{m-1}=l_{k-1}\cdot\mathrm{sign}(i_{m-1})$ may hold.

The obtained potential code vector p is associated with the respective set of basis code vectors $b_x$, wherein l represents the leader vector of this respective set of basis code vectors. For instance, with respect to the example process of determining a code vector based on a basis code vector $b_{x,y,t}$ and scale representative sand described above, the potential code vector p represents the nearest basis code vector $b_{x,y}$ of the set of basis code vectors $b_x$ with respect to the input vector, wherein the absolute valued input vector is used for determining the potential code vector of a respective set of basis code vectors and wherein the sign of each value $b_{x,y,k-1}$ at the kth position of the determined nearest basis code vector $b_{x,y}$ is assigned with the sign of the respective value $i_k$ at the kth position of the input vector i, wherein 0<k≤n holds.

Thus, this nearest basis code vector $b_{x,y}$ representing the potential code vector p can be used for determining a code vector $c_{x,z,y}$ based on the nearest basis code vector $b_{x,y}$ and based on a respective scale representative $s_z$, as described above.

To each truncation a different scale representative is assigned (e.g. through training), e.g.:

float scale[ ]={0.8, 1.2, 2.7};

Accordingly, for instance, a first set of code vectors of a plurality of code vectors of the codebook is defined by the first truncation scaled by the first scale representation 0.8, a second set of code vectors of the plurality of code vectors of the codebook is defined by the second truncation scaled by the second scale representation 1.2, and a third set of code vectors of the plurality of code vectors of the codebook is defined by the third truncation scaled by the third scale representation 2.7, the codebook having a multiple scale lattice structure.

As an example, the search in the multiple scale lattice structure may be seen as having two phases: the first one may compute a potential code vector for each leader class, i.e. for each set of basis code vectors, and the second one may calculate the distortion only for the potential codevectors.

For instance, an absolute value function may be applied to the input vector i such that absolute input vector is comprises the absolute values of the vector i, and then the absolute input vector may be sorted in an descending (or, alternatively, in an ascending) order.

As an example, an index representation may contain representatives indicating the indexes of each input vector i in the descendingly (or ascendingly) ordered absolute valued vector. For instance, said index representation may be an integer array 'indx'.

For example, if the input vector is [−2.4 5.0 −1.3 0.2], the absolute valued vector is [2.4 5.0 1.3 0.2] and the 'indx' array is [1 0 2 3]. Since the leader vectors may be descendingly ordered, during the nearest neighbour search algorithm, the first value of the leader vector may be assigned on the position corresponding to the highest absolute value component of the input vector and so on.

In the following non-limiting example, 'idx_lead_max' is the maximum number of leader classes out of all truncations, which may correspond to X, in this example may be is 9. Accordingly 9 sets of basis code vectors are defined by means of the 9 leader classer, wherein the nth leader class is defined by &pl[n−1].

The distortion metric having the lowest value is determined to represent the best distortion metric, wherein the code vector associated with this distortion metric code vector may be used for encoding the input vector. For instance, this code vector may be defined by the best scale representative and the best potential basis code vector of the set of potential basis code vectors.

In some embodiments the lattice vector quantizer is configured to receive the input vector.

The lattice vector quantizer may be further configured to sort the input vector into an absolute value descending order (it would be understood that in some embodiments the sorting can be performed in an absolute value ascending order with suitable changes to the following operations).

Thus for example if the input vector is l=[−2.4 5.0 −1.3 0.2], the absolute valued vector is absi=[2.4 5.0 1.3 0.2], the sorted absolute valued vector which is defined here as cv_pot1=[5.0 2.4 1.3 0.2]

and the sorting permutation 'indx'=[1 0 2 3].

In some embodiments the lattice vector quantizer is configured to store or generate the leader classes used to generate the codevectors.

For instance the leader classes may be defined as (in value, in other words multiplied by 2)

```
const Word16 pl_fx[ ] =          // Q1 vectors in first layers
{2, 2, 0, 0, 0, 0, 0, 0,
 1, 1, 1, 1, 1, 1, 1, 1,
 2, 2, 2, 2, 0, 0, 0, 0,
 4, 0, 0, 0, 0, 0, 0, 0,
 3, 1, 1, 1, 1, 1, 1, 1,          // 5
 2, 2, 2, 2, 2, 2, 0, 0,
 4, 2, 2, 0, 0, 0, 0, 0,
 3, 3, 1, 1, 1, 1, 1, 1,
 2, 2, 2, 2, 2, 2, 2, 2,
 4, 2, 2, 2, 2, 0, 0, 0,          // 10
 4, 4, 0, 0, 0, 0, 0, 0,
 3, 3, 3, 1, 1, 1, 1, 1,
 5, 1, 1, 1, 1, 1, 1, 1,
 4, 2, 2, 2, 2, 2, 2, 0,
 4, 4, 2, 2, 0, 0, 0, 0,          // 15
 6, 2, 0, 0, 0, 0, 0, 0,
 3, 3, 3, 3, 1, 1, 1, 1,
 5, 3, 1, 1, 1, 1, 1, 1,
 4, 4, 2, 2, 2, 2, 0, 0,
 4, 4, 4, 0, 0, 0, 0, 0          //20
 6, 2, 2, 2, 0, 0, 0, 0,
 3, 3, 3, 3, 3, 1, 1, 1,
 5, 3, 3, 1, 1, 1, 1, 1,
 4, 4, 2, 2, 2, 2, 2, 2,
 4, 4, 4, 2, 2, 0, 0, 0,          // 25
 6, 2, 2, 2, 2, 2, 0, 0,
 6, 4, 2, 0, 0, 0, 0, 0,
 3, 3, 3, 3, 3, 3, 1, 1,
 5, 3, 3, 3, 1, 1, 1, 1,
 5, 5, 1, 1, 1, 1, 1, 1,          //30
 7, 1, 1, 1, 1, 1, 1, 1,
 4, 4, 4, 2, 2, 2, 2, 0,
 4, 4, 4, 4, 0, 0, 0, 0
 6, 2, 2, 2, 2, 2, 2, 2,
 6, 4, 2, 2, 2, 0, 0, 0,};
```

In some embodiments the lattice vector quantizer 453 may determine the output code vector associated with the input vector.

Where the distance to be determined is a weighted Euclidean distance then in some embodiments the weights are transposed according to the permutation vector and an intermediary input vector produce is generated. It would be understood that in some embodiments the weights are uniform or the weighting operation is optional where the unweighted Euclidean distance is employed.

These may then be output by the signal output 207.

Figure 4:
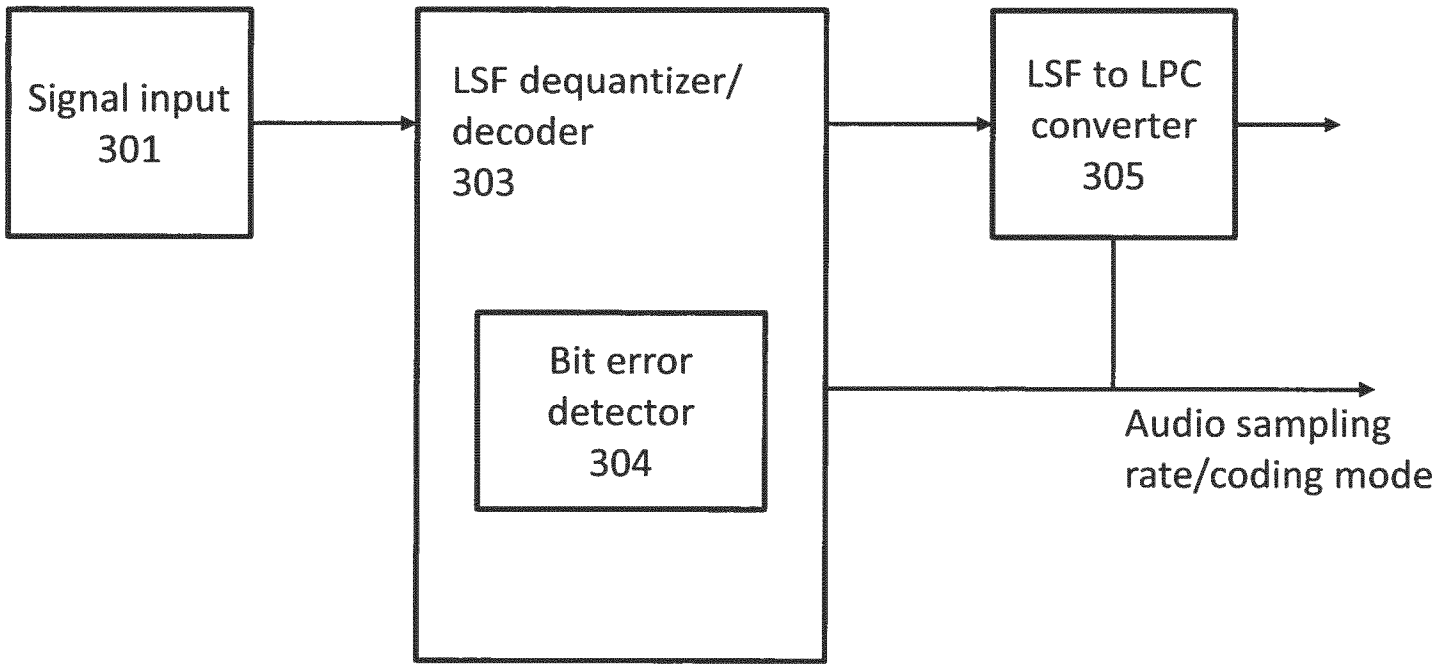
FIG. 4 shows schematically a decoder as shown in FIG. 2 according to some embodiments.

FIG. 4 shows schematically the decoder 108 according to some embodiments.

The concept for the embodiments as described herein is to determine and apply decoding to encoded audio signals to produce efficient high quality audio output and furthermore to determine whether bit errors have occurred within the transmission and/or storage process. To that respect with respect to FIG. 4 an example decoder 104 is shown according to some embodiments. In the following examples the decoder is configured to receive encoded frequency domain parameters representing the audio signal and decode the encoded frequency domain parameters which have been vector lattice quantized, however it would be understood that in some embodiments the parameters can be any suitable parameters defining or representing the audio signals or other type of signals (for example image or video).

The decoder 108 in some embodiments may comprise a signal input 301 configured to receive the encoded audio signals. The signal input 301 can thus in some embodiments be how the encoded bit stream 112 may be received. As part of the received bit stream 112 there may be quantized LSF coefficient indices which may form part of the encoded parameter set for a speech or audio decoder.

The speech or audio decoder in embodiments may be arranged to operate at varying number of samples per output audio frame and at varying output sampling frequency. In other words, the decoder 108 may be arranged to output a frame of a reconstructed audio signal whereby the number of samples and the sampling rate of the frame may be varied from one frame to the next.

Furthermore the decoder 108 may be arranged to operate with a number of different modes of decoding, where the mode of decoding used may be dependent on the audio frame sampling frequency.

Further still, the bit rate of the encoded parameter set may be different according to the mode of coding used by the encoder.

The signal input 301 may pass the encoded quantized audio signal components to a LSF dequantizer/decoder 303.

In some embodiments the speech or audio decoder may be a core layer decoder whose reconstructed audio output may be combined with further reconstructed audio signal outputs from higher layer decoders. The encoded higher layer bits may be sent to the decoder along with the corresponding encoded core layer bits.

With reference to FIG. 4, the quantized LSF indices received as part of the encoded bit stream 112 may be arranged to be passed to the input of a LSF dequantizer 303.

In other words there may be provided means for receiving a set of encoded audio parameters, wherein the set comprises indices representing at least two quantized line spectral frequency coefficients, wherein the audio frame when decoded comprises audio samples digitally sampled at a sampling frequency, wherein the sampling frequency is one of a plurality of sampling frequencies for an audio decoder.

In embodiments the LSF dequantizer 303 may be configured to convert the received quantized LSF indices to quantized LSF coefficients.

It is to be appreciated in embodiments that the LSF dequantizer 303 may produce a number of quantized LSF coefficients for each audio frame. The number of quantized LSF coefficients can be predetermined at the encoder by as the prediction order of a LPC analyser. For example, in the instance of the LPC analyser determining a prediction order of the magnitude 16, then the number of quantized LSF coefficients produced by the LSF dequantizer 303 would be also 16.

In other words there may be provided means for converting the indices to the at least two quantized line spectral frequency coefficients.

In some embodiments the LSF dequantizer 303 may comprise a bit error detector 304. The bit error detector may comprise a series of bit error detector modules configured to detect or determine whether the received signals comprise any bit errors and manage the output based on determining a bit error.

Figure 5:
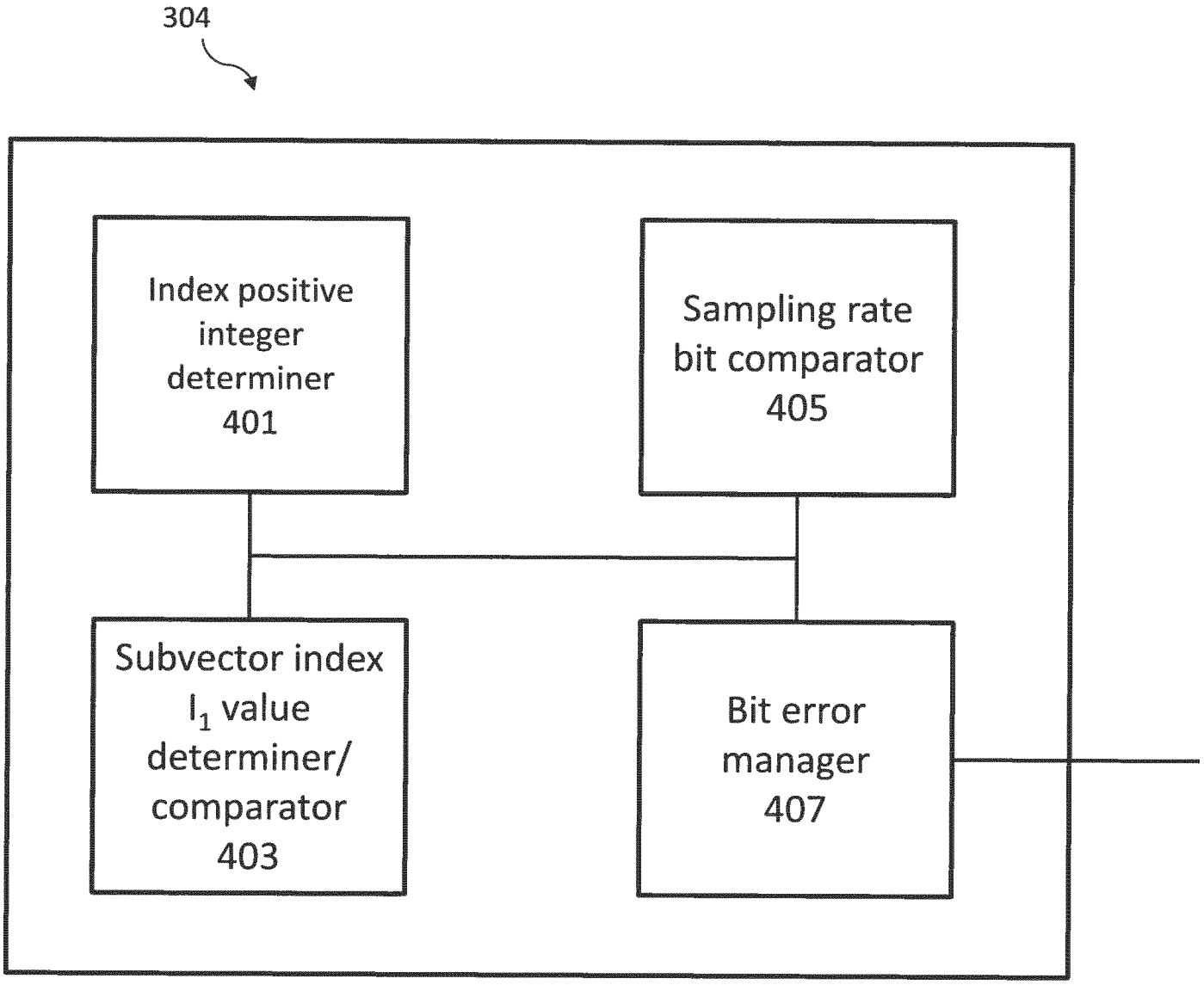
FIG. 5 shows schematically a bit error detector as shown in FIG. 4 according to some embodiments.

With respect the FIG. 5 a schematic view of the bit error detector 304 is shown in further detail. In the example shown in FIG. 5 three separate bit error detecting modules are shown however it is understood that in some embodiments there may be one or two of the following detecting modules coupled to the bit error manager module.

In some embodiments the bit error detector 304 comprises an index positive integer determiner 401. The operations of the index positive integer determiner 401 are further shown with respect to the flow diagram in FIG. 6.

In some embodiments the index positive integer determiner may be configured to determine or retrieve the index integer values I.

Figure 6:
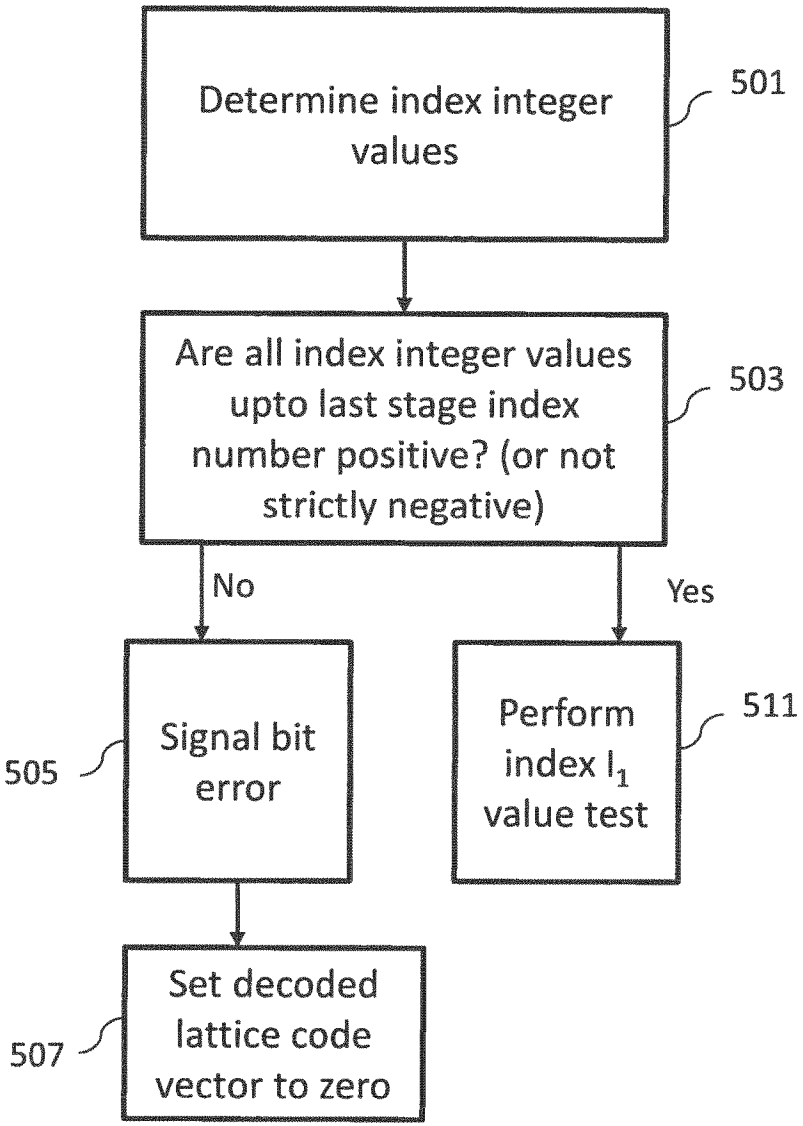
FIG. 6 shows a flow diagram illustrating the operation of the index positive integer determiner shown in FIG. 5.

The operation of determining the index integer values is shown in FIG. 6 by step 501.

Having determined or retrieved the index integer values I the index positive integer determiner 401 may be configured to determine whether all of the index integer values up to the last stage index number are positive. Thus for example in some embodiments the index positive integer determiner may be configured to determine whether all the 16 integers forming the index are positive. By all integers it is meant up to the number of bits that the last stage index I is supposed to have. This means that if I uses less than 32 bits, then only the first two 16 bit integers should be checked.

In some embodiments the determination may be made by determining whether the index (16 bit) integers are strictly negative.

The operation of determine whether all index integer values up to the last stage are positive (or not strictly negative) is shown in FIG. 6 by step 503.

In some embodiments where it is determined at least one of the integer values is negative then a bit error is signalled to the bit error manager 407.

The operation of signalling a bit error is shown in FIG. 6 by step 505.

In some embodiments the bit error detector comprises a bit error manager 407. The bit error manager 407 may for example be coupled to the index positive integer determiner and be configured to receive a signal indicating a bit error has been detected. In some embodiments the bit error manager 407 may be configured to set the decoded lattice codevector to zero.

The operation of setting the decoded lattice codevector to zero is shown in FIG. 6 by step 507.

In some embodiments where it is determined that all of the integer values are positive then a further check or test may be performed. For example as shown in FIG. 6 step 511 the bit error detector may be configured to perform an index $I_1$ value test.

In some embodiments the bit error detector 304 comprises a subvector index $I_1$ value determiner/comparator 403. The subvector index $I_1$ value determiner/comparator 403 may be configured to perform the index $I_1$ value test as shown in FIG. 7.

The subvector index $I_1$ value determiner/comparator 403 may be configured to receive the combined index I values.

Figure 7:
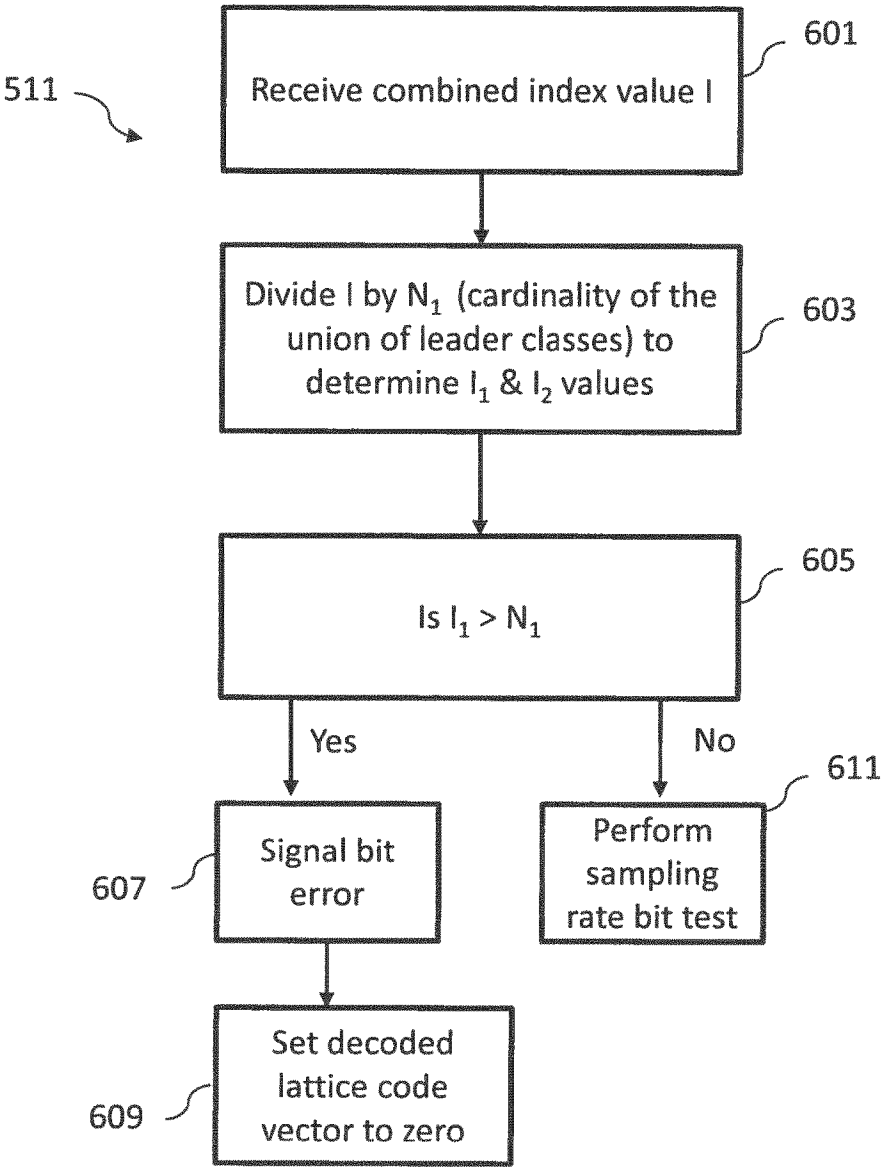
FIG. 7 shows a flow diagram illustrating the operation of the subvector index value determiner shown in FIG. 5.

The operation of receiving the combined index I values is shown in FIG. 7 by step 601.

The index I of the 16 dimensional lattice codevector may for example be formed at the encoder by $$I=N_2I_1+I_2.$$

where $I_1$ and $I_2$ are the indexes of the two subvectors of dimension 8 that form the 16 dimensional residual vector to be quantized and $N_2$ is the cardinality of the union of leader classes forming the lattice codebook for the second subvector.

The subvector index $I_1$ value determiner/comparator 403 may be configured to divide I by $N_2$, and thus be able to determine the $I_1$ and $I_2$ values. This for example may be obtained by dividing the 64 bit I value by a 32 bits $N_2$ value. In such an example the 64 bit I integer is represented as a succession of integers on 16 bits.

The operation of dividing the index I value by the $N_2$ value is shown in FIG. 7 by step 603.

Although as defined by the equation above $I_2$ is ensured to be less than $N_2$, nothing prevents the decoded $I_1$ value to be larger than the cardinality of the union of leader classes forming the codebook for the first 8 dimensional subvector, $N_1$. When it is determined that $I_1$ is larger than the allowed amount it indicates at least one bit error is present in the original index. Furthermore since the original index I is not formed by mere concatenation of two indexes, it means that also the decoded index 12, obtained after division is affected by bit errors.

In other words determining within the data at least one bit error may comprise determining from the data a combined index value I, dividing the combined index value I by a cardinality of a union of leader classes $N_2$ for the second subvector employed in the lattice vector quantization of the parameter values representing the at least one audio signal to generate at least two sub-indexes associated with sub-vectors of the quantized parameter values, and determining the most-significant sub-index comprises a value greater than the cardinality of a union of leader classes $N_1$ for the first subvector.

In the example shown herein there are two sub-vectors and thus two cardinalities $N_1$ and $N_2$. This method may be performed in embodiments where more than two sub-vectors are encoded.

In such an embodiments there could be a combined index from more than two indices (for example three indices):

$$I=I_1*(N_2*N_3)+(I_2*N_3+I_3)$$

This is therefore similar to the two index example but a combination of the indices or the cardinalities other than those associated with the first sub-vector index $N_2*N_3$ replaces $N_2$ and $I_2*N_3+I_3$ replaces $I_2$. Thus in this example by dividing the combined index by a combination of the indices or the cardinalities other than the first sub-vector index generates the $I_1$ value which may be tested against the $N_1$ value.

This may be further expanded such that in general $$I=I_1*N_2*\ldots*N_n+I_2*N_3*\ldots*N_n+\ldots+I_{(n-1)}*N_n+I_n.$$

Thus in some embodiments the subvector index $I_1$ value determiner/comparator 403 may be configured to compare the decoded $I_1$ value against the $N_1$ value.

The operation of comparing the decoded $I_1$ value against the $N_1$ value to determine whether the $I_1$ value is greater than the $N_1$ value is shown in FIG. 7 by step 605.

In some embodiments where it is determined that the $I_1$ value is greater than the $N_1$ value then a bit error is signalled to the bit error manager 407.

The operation of signalling a bit error is shown in FIG. 7 by step 607.

In some embodiments the bit error manager 407 may be coupled to the subvector index $I_1$ value determiner/comparator 403 and be configured to receive a signal indicating a bit error has been detected. In some embodiments the bit error manager 407 may be configured to set the decoded lattice codevector to zero.

The operation of setting the decoded lattice codevector to zero is shown in FIG. 7 by step 609.

In some embodiments where it is determined that the subvector index $I_1$ value is less than the $N_1$ value then a further check or test may be performed. For example as shown in FIG. 7 step 611 the bit error detector may be configured to perform a sampling rate bit test.

In some embodiments the bit error detector 304 comprises a sampling rate bit comparator 405. The sampling rate bit comparator 405 may be configured to perform the sampling rate bit test as shown in FIG. 8.

The sampling rate bit comparator 405 may in some embodiments be configured to determine whether the current decoded frame is a comfort noise generation frame. Or in other words whether the decoder is currently in a comfort noise generation mode.

Figure 8:
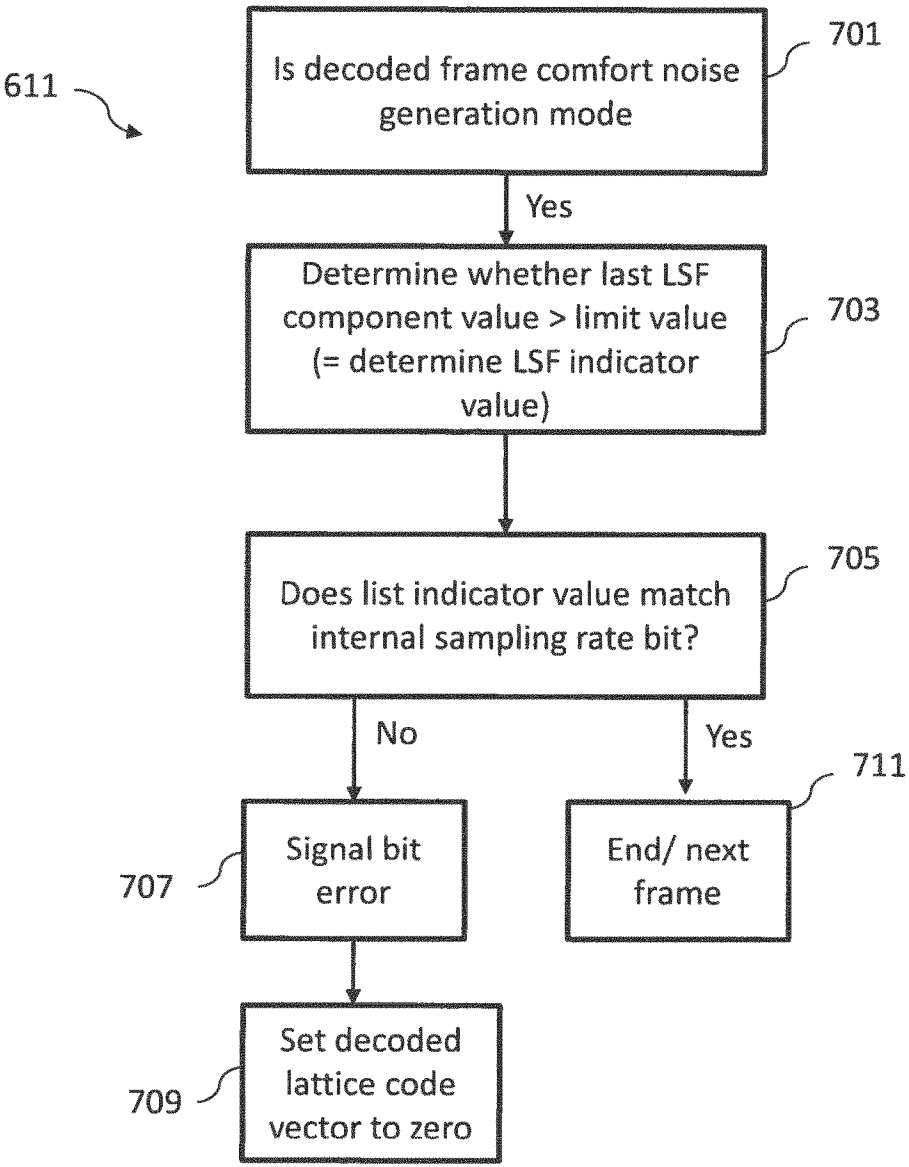
FIG. 8 shows a flow diagram illustrating the operation of the sampling rate bit comparator shown in FIG. 5.

The operation of determining whether the decoded frame is a comfort noise generation (CNG) frame is shown in FIG. 8 by step 701.

be an indicator of the internal sampling rate being 12.8 kHz or 16 kHz in the sense that if it is larger than a particular value, WB_LIMIT_LSF, it signals 16 kHz internal sampling rate.

In some embodiments the indicator may be any suitably determined LSF value.

The operation of determining from the last LSF component value is greater than a limit value and thus determine a LSF indicator value is shown in FIG. 8 by step 703.

Furthermore in some embodiments there is also received a bit signaling the internal sampling rate.

Thus in some embodiments the sampling rate bit comparator 405 may perform the following check

```
IF (((sub(st_fx->L_frame_fx, L_FRAME16k)==0)&&(sub(lsf_q[M-1]
        ,WB_LIMIT_LSF_FX)<=0)) || ((sub(st_fx->L_frame_fx, L_FRAME16k)<0)
&&    (sub(lsf_q[M-1],WB_LIMIT_LSF_FX)>0)))
        {
            st_fx->BER_detect = 1; move16( );
        }
```

where L_frame_fx is the frame length equal to 320 samples for 16kHz and 256 samples for 12.8kHz, lsf_q the quantized decoded LSF vector, M=16, L_FRAME16k = 320, a bit error can be detected.

When it is determined that the decoder is operating in a CNG mode a further bit error detection operation may be performed after the determination of the full LSF decoded vector.

In some embodiments the input audio signal is coded by deploying a layered coding regime, and where the core layer codec can operate at different sampling rates corresponding to different modes of encoding. The particular sampling rate and mode of coding used by the core layer codec may be identified by firstly inspecting the value of the last or highest frequency LSF, and then assigning the value to a particular frequency range.

In other words, the decoding mode of a multimode decoder may be determined by the value of the last or highest frequency LSF.

In some embodiments in which the core layer codec may be arranged to operate in one of two modes of operation. The first mode of operation may be at an audio frame sampling frequency of 12800 Hz, and the second mode of operation maybe at a sampling frequency of 16000 Hz. Thus if the received last or highest frequency quantized LSF for an audio frame is determined to be in the frequency range from 3950 Hz to 6350 Hz then operating mode of the core layer decoder may be the mode for decoding the parameters of an audio frame sampled at 12800 Hz. However, if the received last or highest frequency quantized LSF for an audio frame is determined to be in the frequency range from 6350 Hz to 7950 Hz then the operating mode of the core layer decoder may be mode for decoding the parameters of an audio frame sampled 16000 Hz.

In other words there is provided means for determining the sampling frequency for an audio frame by checking the value of a last or highest frequency quantized line spectral frequency coefficient of the received quantized line spectral frequency coefficients.

For example when the first stage codebook for the LSF encoding in a CNG mode is composed of 16 codevectors, the first 6 codevectors may be allocated for the internal sampling rate of 16 kHz and the rest (10 codevectors) may be allocated for an internal sampling rate of 12.8 kHz. In such embodiments the value of the last LSF component may The operation of comparing whether the sampling rate LSF indicator value matches the internal sampling rate bit is shown in FIG. 8 by step 705.

In some embodiments where the sampling rate LSF indicator value does not match the internal sampling rate bit a bit error is signalled to the bit error manager 407.

The operation of signalling a bit error is shown in FIG. 8 by step 707.

In some embodiments the bit error manager 707 may be coupled to the sampling rate bit comparator 405 and be configured to receive a signal indicating a bit error has been detected. In some embodiments the bit error manager 407 may be configured to set the decoded lattice codevector to zero.

Although the examples described herein feature setting the decoded lattice codevector to zero in some embodiments the bit error manager 407 may be configured to set the decoded lattice codevector to a determined or generic value when a bit error is detected.

The operation of setting the decoded lattice codevector to zero is shown in FIG. 8 by step 709.

It is to be understood in embodiments that the operating mode of the decoder may be dependent on the sampling rate of the audio frame. Hence, a signaling line can convey the mode of decoding by either directly carrying the coding mode or alternatively the sampling rate.

It is to be understood therefore that the LSF dequantizer 303 may be configured to have two outputs.

The first output may be arranged to be connected to the input of a LSF to LPC converter 305 and may comprise the set of quantized LSF coefficient values.

The second output from the LSF dequantizer 303 may comprise the signaling line which may be used to convey the coding mode and/or sampling rate to subsequent decoding components in the decoder 108.

In some embodiments the quantized LSF coefficient values may be received by the LSF to LPC converter 512 and subsequently converted to a set of LP coefficients.

In order to assist with the conversion process the LSF to LPC converter 512 may be arranged to receive the signalling line as a further input. The signalling line may indicate the sampling frequency of the encoded audio frame and therefore determine the order of the LSF to LPC conversion process.

Alternatively, in other embodiments the signalling line may carry the coding mode which can be used to determine the order of the LSF to LPC conversion process.

The number of elements in the set of LP coefficients will be equivalent to the prediction order.

It is to be understood that the LP coefficients produced by the LSF to LPC converter 305 will correspond with an output audio frame.

It is to be further understood that the output of the LSF to LPC converter 305 may be used by further decoding components in the decoder 108. For example, the LP coefficients may be used as the filter coefficients for any subsequent LP filter.

Furthermore, the signalling line may also be used by further decoding components in order to select the appropriate mode of decoding for the further decoding components in the decoder 108.

The decoding components of the decoder 108 may then form the output audio signal 114.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analogue and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require so are or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying so are and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

receiving encoded lattice vector quantized parameter data, the lattice vector quantized parameter data representing a frame of at least one audio signal;

determining within the encoded lattice vector quantized parameter data at least one bit error based on at least:

determining from the encoded lattice vector quantized parameter data a combined index value;

dividing the combined index value by a cardinality of a union of leader classes for at least one subvector other than a first subvector employed in lattice vector quantization of parameter values representing the frame of the at least one audio signal to generate a first subvector index and a second subvector index associated with the first subvector and a second subvector, respectively, of the encoded lattice vector quantized parameter data;

determining the most-significant sub-index comprises a value greater than the cardinality of a union of leader classes for the first subvector; and generating an indicator that the encoded lattice vector quantized parameter data comprises the at least one bit error; and controlling decoding of the encoded lattice vector quantized parameter data to generate a further audio signal based on the determining of the at least one bit error.

2. The method as claimed in claim 1, wherein determining within the encoded lattice vector quantized parameter data at least one bit error comprises:

determining, from the encoded lattice vector quantized parameter data, index integer values forming an index;

determining that at least one of the index integer values forming the index is negative; and generating an indicator that the encoded lattice vector quantized parameter data comprises the at least one bit error.

3. The method as claimed in claim 1, wherein determining within the encoded lattice vector quantized parameter data at least one bit error comprises:

determining the encoded lattice vector quantized parameter data represents a comfort noise generation audio frame;

determining a defined parameter component value;

determining the defined parameter component value is greater than a defined limit value, wherein the defined parameter component value being greater than the defined limit value indicates a sampling rate of a decoder;

determining a signalling bit indicating a value of the sampling rate of the decoder;

determining the sampling rate of the decoder based on the defined parameter component value does not match the value of the sampling rate of the decoder based on the signalling bit; and generating an indicator that the encoded lattice vector quantized parameter data comprises the at least one bit error.

4. The method as claimed in claim 3, wherein the defined parameter component value is a last or a highest frequency quantized parameter.

5. The method as claimed in claim 3, wherein the defined parameter component value is a highest order quantized parameter.

6. The method as claimed in claim 1, wherein controlling the decoding of the encoded lattice vector quantized parameter data to generate a further audio signal based on the determining of the at least one bit error comprises:

setting a codevector associated with the encoded lattice vector quantized parameter data to a defined value.

7. The method as claimed in claim 6, wherein setting the codevector associated with the encoded lattice vector quantized parameter data to a defined value comprises setting the codevector to zero.

8. The method as claimed in claim 1, wherein a parameter of the encoded lattice vector quantized parameter data is a line spectral frequency.

9. An apparatus comprising at least one processor, and memory including computer program code, the memory and the computer program code configured to, with the at least one processor, cause the apparatus to:

receive encoded lattice vector quantized parameter data, the encoded lattice vector quantized parameter data representing a frame of at least one audio signal;

determine within the encoded lattice vector quantized parameter data at least one bit error by the apparatus being configured to at least:

determine from the encoded lattice vector quantized parameter data a combined index value;

divide the combined index value by a cardinality of a union of leader classes for at least one subvector other than a first subvector employed in lattice vector quantization of parameter values representing the frame of the at least one audio signal to generate a first subvector index and a second subvector index associated with the first subvector and a second subvector, respectively, of the encoded lattice vector quantized parameter data;

determine the most-significant sub-index comprises a value greater than the cardinality of a union of leader classes for the first subvector; and generate an indicator that the encoded lattice vector quantized parameter data comprises the at least one bit error; and control the decoding of the encoded lattice vector quantized parameter data to generate a further audio signal based on the determining of the bit error.

10. The apparatus as claimed in claim 9, wherein the apparatus caused to determine within the encoded lattice vector quantized parameter data at least one bit error is further caused to:

determine, from the encoded lattice vector quantized parameter data, index integer values forming an index;

determine that at least one of the index integer values forming the index is negative; and generate an indicator that the encoded lattice vector quantized parameter data comprises the at least one bit error.

11. The apparatus as claimed in claim 9, wherein the apparatus caused to determine within the encoded lattice vector quantized parameter data at least one bit error is further caused to:

determine the encoded lattice vector quantized parameter data represents a comfort noise generation audio frame;

determine a defined parameter component value;

determine the defined parameter component value is greater than a defined limit value, wherein the defined parameter component value being greater than the defined limit value indicates a sampling rate of the decoder;

determine a signalling bit indicating a value of the sampling rate of the decoder;

determine the sampling rate of the decoder based on the defined parameter component value does not match the value of the sampling rate of the decoder based on the signalling bit; and generate an indicator that the encoded lattice vector quantized parameter data comprises the at least one bit error.

12. The apparatus as claimed in claim 11 wherein the defined parameter component value is a last or a highest frequency quantized parameter.

13. The apparatus as claimed in claim 11, wherein the defined parameter component value is a highest order quantized parameter.

14. The apparatus as claimed in claim 9, wherein the apparatus caused to control the decoding of the encoded lattice vector quantized parameter data to generate an audio signal based on the determining of the at least one bit error is further caused to:

set a codevector associated with the encoded lattice vector quantized parameter data to a defined value.

15. The apparatus as claimed in claim 14, wherein the defined value is zero.

16. The apparatus as claimed in claim 9, wherein a parameter of the encoded lattice vector quantized parameter data is a line spectral frequency.

* * * * *